US006644326B2

(12) United States Patent
Dorton et al.

(10) Patent No.: US 6,644,326 B2
(45) Date of Patent: Nov. 11, 2003

(54) PROCESS FOR CLEANING POLYMERIC FOULING FROM EQUIPMENT

(76) Inventors: Michael R. Dorton, 1812Candlestick La., Midland, TX (US) 48642; Gary L. Gardner, Sr., 120 Post Oak Rd., Lake Jackson, TX (US) 77566

( * ) Notice: Subject to any disclaimer, the term of this patent is extended or adjusted under 35 U.S.C. 154(b) by 0 days.

(21) Appl. No.: 10/235,422

(22) Filed: Sep. 4, 2002

(65) Prior Publication Data

US 2003/0073595 A1 Apr. 17, 2003

Related U.S. Application Data

(60) Provisional application No. 60/317,254, filed on Sep. 5, 2001.

(51) Int. Cl.[7] ..... C11D 3/43

(52) U.S. Cl. ..... 134/22.14; 134/2; 134/22.12; 134/22.18; 134/22.19; 510/188; 510/407; 510/432

(58) Field of Search ..... 510/188, 432, 510/407, 417; 134/40, 2, 12, 26, 38, 13, 31, 22.1, 22.14, 22.12, 22.18, 22.19

(56) References Cited

U.S. PATENT DOCUMENTS 3,660,160 A * 5/1972 Powers et al. ..... 134/22.19
4,176,131 A 11/1979 Shih et al.
4,925,497 A * 5/1990 Thierheimer, Jr. ..... 134/40
5,487,836 A 1/1996 Mason et al.
5,659,036 A 8/1997 Maki et al.
5,789,591 A 8/1998 Chu et al.
5,817,817 A 10/1998 Maki et al.

OTHER PUBLICATIONS

The Dow Chemical Company; Dowtherm Q Heat Transfer Fluid, Product Technical Data, NA/LA/Pacific: Form No. 176–01407–697 AMS Europe: CH 153–041–E–697; Published Jun., 1997.

The Dow Chemical Company; Equipment For Systems Using Dowtherm Heat Transfer Fluids, Includes heat transfer system hardware and fabrication guidelines; Form No. 176–01335–894AMS, Aug., 1994.

* cited by examiner

*Primary Examiner*—Gregory E. Webb
(74) *Attorney, Agent, or Firm*—Jenkens & Gilchrist

(57) ABSTRACT

A process is described for removing olefinic polymer mass buildup fouling process equipment to restore the efficiency of such equipment. This is accomplished by circulating through the equipment in contact with the polymer an aromatic hydrocarbon solvent having a high boiling point and low vapor pressure for a period of time sufficient to remove the polymer. The solvent is recovered for reuse by a flash separation from the removed olefinic polymer mass.

14 Claims, 3 Drawing Sheets

60
From Fig. 1
26
From Fig. 1
28
30
31
32
33
34
35
36
37
38
39
40
41
42
43
44
45
46
47
48
49
To Fig. 3
50
51
52
53
54
55
56

To Fig. 1
From Fig. 2
61
62
63
64
65
66
67
68
69
70
71
72
73
74
75
76
77
78
79
80
49

PROCESS FOR CLEANING POLYMERIC FOULING FROM EQUIPMENT

PRIOR RELATED APPLICATION

This application claims priority to U.S. Provisional Patent Application Serial No. 60/317,254 filed on Sep. 5, 2001, the disclosures of which are incorporated herein by reference.

FEDERALLY SPONSORED RESEARCH STATEMENT

Not applicable.

REFERENCE TO MICROFICHE APPENDIX

Not applicable.

FIELD OF THE INVENTION

The present invention is directed to a process for cleaning olefinic polymeric fouling from surfaces of reactors, heat exchangers and other process equipment in which polymerized olefins are produced by solution polymerization processes. More specifically, the inventive process is directed to a method whereby the polymeric fouling is dissolved into a high boiling, low vapor pressure aromatic hydrocarbon solvent and removed from the equipment to restore operating efficiency.

BACKGROUND OF THE INVENTION

During the manufacture of olefinic polymers by solution polymerization such as, for example, polystyrene and the various copolymers of styrene and other olefinic monomers, finished polymer gradually builds up over a period of time on the surfaces of the process equipment where the material is produced reducing the efficiency of the reactions and ultimately requiring such polymer-fouled equipment to be removed from operation; and ultimately requiring that the equipment, under present practice, be transported to a specialized facility where the polymer is literally burned off of the fouled surfaces in specially-constructed furnaces to remove it. In order to transport such polymer-fouled equipment, environmental and safety requirements are such that, before leaving the plant gates, the polymer and equipment must be steamed to remove liquid solvents, usually the medium in which polymerization took place, which may be adhering to the surfaces of the contamination or the equipment itself. This operation occurs at a considerable expense and after the equipment is put back into service, it usually must be again removed for cleaning after an average of only about four months. Thus, it is an object of this invention to provide a process whereby the surfaces of polymeric reactors and heat exchangers which become fouled and contaminated with olefinic polymer buildup can be cleaned without the necessity of transportation from the plant facility. It is also an object of this invention to provide a polymer removal alternative to pyrolysis. It is a still further objective of this invention to lengthen the operation cycles of the equipment between cleaning.

It is an additional objective of this invention to provide a process whereby such reactor surface cleaning may be accomplished by dissolving the polymer in a solvent and removing it as a liquid from the reactor without dismantling equipment or transporting the equipment to off-site facilities.

A still further object of this invention is to provide a flexible process which allows an operator to remove polymer deposits from equipment surfaces at either an on-site or off-site location.

SUMMARY OF THE INVENTION

The above objects and other advantages of this invention are accomplished by contacting the fouled surfaces at elevated temperatures with a high boiling, aromatic hydrocarbon solvent having a boiling point above about 400° F. and having a low vapor pressure at the solvating temperatures for a particular olefinic hydrocarbon. The process is particularly applicable to the use of some fluids commonly known as thermal fluids which exhibit solvent capacity for the olefinic polymer involved. These thermal fluids are generally aromatic hydrocarbons, normally characterized as being phenylalkyls, biphenyls, or diphenyl ethers, and mixtures thereof. The olefin polymer fouling particularly suited for this application occur from the solution polymerization of monomers having double bonds, which are susceptible to polymerization such as, for example, ethylene, propylene, butylene, butadiene, pentene, pentadiene and styrene, and other vinylidene polymers to cite a few examples.

These olefins are polymerized under solution polymerization conditions in the presence of catalysts which are well known in the art. The hydrocarbon solvents in which the catalytic polymerization reaction occurs are also well known to those in the art to include; for example, cyclohexane, hexane, octane, cyclo-octane and generally oxygen free liquid alkanes or mixtures thereof sold under various trademarks (ExxonMobil's ISOPAR E is an example). These polymerization reaction solvents have higher vapor pressure solvents which are normally easy to separate from the reaction product polymers. The solution polymerization reaction conditions, solvents, and catalysts are those generally recognized as Ziegler-Natta catalysts and variations thereof, and improvements thereon, continue up through the present.

When polymerized, either as homopolymers, dimer polymers, block co- and terpolymers or heteropolymers that are useful in commerce, a polymeric mass collects which can be dissolved from equipment surfaces through the use of the process of this invention. The contacting of the polymer occurs at elevated temperatures above about 200° F., preferably at a temperature of from about 250° F. to about 600° F. Those versed in the art will recognize that at higher temperatures the driving forces dissolving the polymer will be higher and thus require less contact time. Higher temperature may also cause higher pressure to be required to prevent the residual polymerization solvent or the aromatic high-boiling solvent from boiling where the solvent selection makes this a factor.

One particularly preferred aromatic hydrocarbon solvent is available as a thermal fluid as a mixture of from about 50 wt % to about 66 wt % 1,1-diphenyl-ethane and from about 34 wt % to about 50 wt % of an ethylated benzene sold by Dow Chemical Company under its trademark DOWTHERM™ Q and available as HP Solve™ 515 from Apogee Engineering. The preferred DOWTHERM™ Q solvent mixture has a vapor pressure of about 0.002 mmHg at 25° C., making it very desirable for use in the practice of this invention. By "low vapor pressure" is meant a vapor pressure below about 0.01 mmHg at 25° C. Generally acceptable for the practice of this invention are those aromatic hydrocarbon solvents having a vapor pressure of from about 0.001 to about 0.01 mmHg at 25° C.

The process of this invention is practiced by enclosing the fouled equipment surface in either a container designed to fit the equipment or by using the process equipment on the plant facility such as cleaning heat exchanger tubes without removing them from the shell. The equipment may be taken out of service isolated from the rest of the process and connected to a processing system, which heats the treatment fluid to its useful temperature and circulates it through the fouled equipment as mentioned before, preferably a circulation loop. The equipment may also remain in place and existing processing equipment used to circulate and heat the treatment fluid. The heated fluid is pumped into the equipment, such as a reactor or heat exchanger, and is allowed to dissolve at least some of the polymer from the surfaces of the equipment. The solubility of the polymer fouling within the equipment will determine the amount of solvent which must be committed to complete a particular cleaning job and the amount of time required to complete the job. It is contemplated that several cycles of contacting the fouled equipment will be required to completely clean the equipment. It is preferred that the heated solvent be circulated through the equipment to collection tanks where, once it nears saturation with the polymer, it is held for separation, disposal or reuse.

Of course, another aspect of this invention involves the separation of the polymer dissolved in the solvent such that the solvent can be recovered and reused, either in subsequent batch operations or during the circulation and defouling steps. This is accomplished by boiling, or flashing, the solvent in a container under vacuum, usually in the presence of an antifoam agent, which allows the solvent to be separated from the polymer and collected in an additional vessel or by flashing the heated and pressurized mixture into an appropriate vessel. Lower boiling point liquid solvents from the polymerization reaction should be removed from the process equipment before removal of the polymeric olefin fouling deposits. Usually there is some residual reaction solvent present with the polymer. This solvent can also be recovered from the high boiling solvent of this invention and reused. This recovered low boiling point solvent can then be recycled back into the original polymerization process for cost reduction and waste minimization.

DETAILED DESCRIPTION OF THE INVENTION

Figure 1:
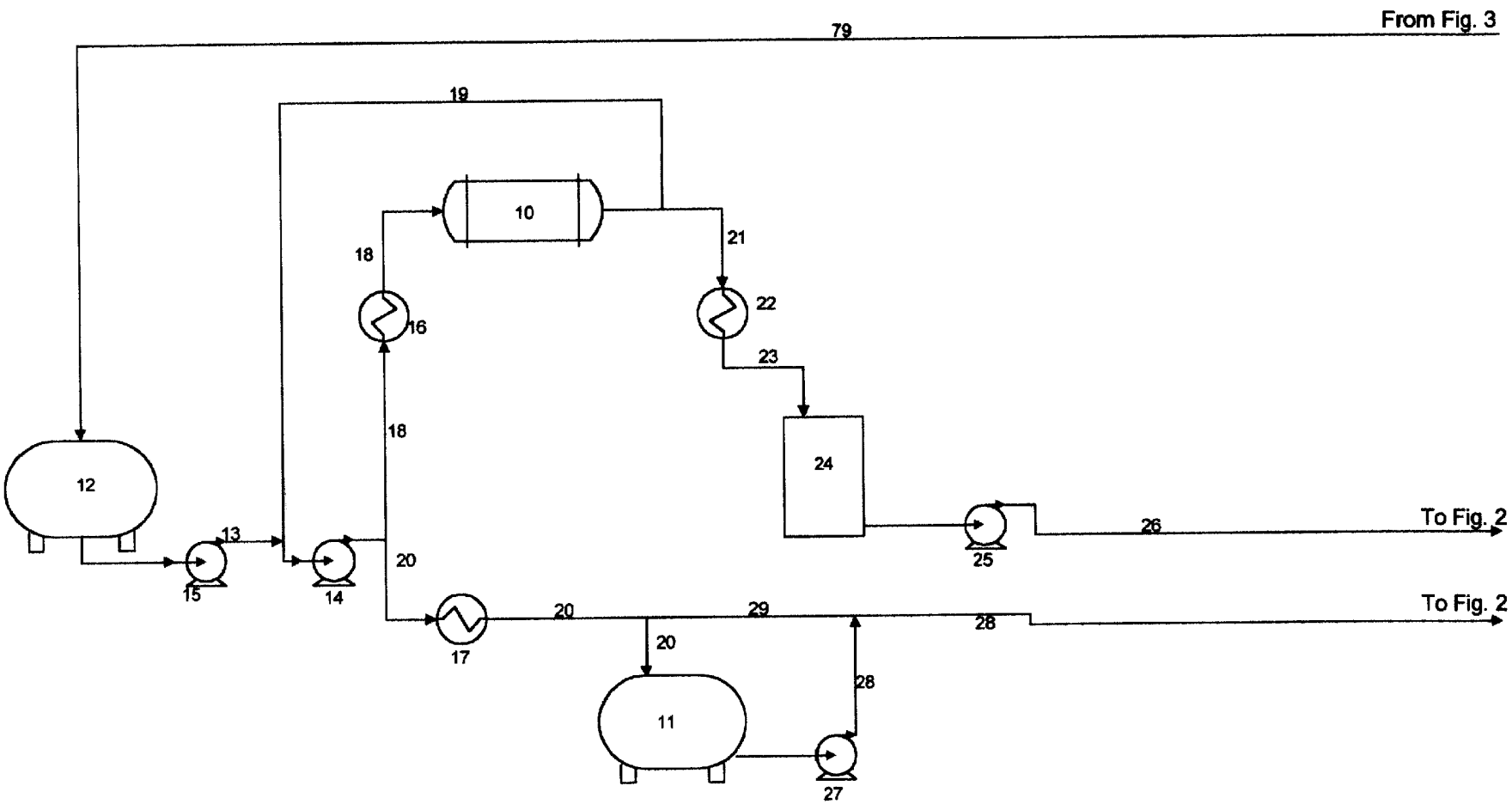
FIGS. 1, 2 and 3 are simplified schematic diagrams depicting an embodiment of the process of the instant invention which includes solvent recovery and recycle.

The use of polymers, particularly olefinic polymers, is widespread in almost every walk of commercial life. Replacement of other materials with polymers in objects and necessities of everyday life is occurring in almost every product from cameras through automobiles and airplanes. Olefinic polymers make up a very high percentage of these materials. These polymers are often prepared in reaction systems whereby an olefin monomer is catalytically polymerized in a low boiling hydrocarbon solvent. The polymerization occurs in a reactor which is either cooled or heated by indirect heat exchange, often in a shell and tube bundle configuration. In the shell and tube configuration, the reaction can occur either on the tube side or the shell side of the equipment and the use of the cleaning process of this invention is applicable to either configuration. It is also applicable to other types of equipment which may be contacted by the polymer either during or after polymerization reaction occurs. Some polymerizations occur in stirred reactors or a series of continuous stirred reactors thus the polymer build up may be on virtually any surface which comes into contact with the olefinic polymer. Even the inside of pipes may be fouled by the polymer such that the clean up process of this invention may be applicable. Accordingly when the term process equipment is used, it could apply to any of the vessels which are contacted by the olefinic polymer fouling.

With the passage of time, a polymeric coating mass collects on the surfaces of the equipment. For example, if the fouled equipment is a shell and tube device, it would accumulate on the heat exchanger-type tubes and the inside surface of the shell containing the tubes causing a loss of operational efficiency. Of course, the build-up could occur just as well in the tubes of a reactor when the polymerization reaction takes place on the tube side. The practice of the cleaning process of this invention can be practiced wherever the mass accumulates.

The olefinic polymers particularly adapted for removal in the practice of this invention include, but are not limited to, polyethylene, polypropylene, polyvinylchloride, ethylene-propylene copolymers, polybutydiene, polystyrene, ethylene-propylene rubber copolymer EPM, and ethylene-propylene rubber terpolymers of EPDM, polypentadiene, polyisoprene and styrene-butydiene isoprene terpolymers, terpolymers such as SBR rubbers and SBS rubbers. When the polymer is in the form of a rubber latex of numerous monomer combinations, it can be removed by the practice of this invention. A simple laboratory test of heating a sample of the polymer in a beaker or flask containing the solvent of this invention can be used to select the solvent and determine the appropriate temperature as well as the solubility of the olefin polymer fouling in the solvent.

The practice of this invention involves contacting the mass of built-up olefinic polymers fouling the passages in the processing equipment with an aromatic hydrocarbon solvent having a high boiling point, and normally-low vapor pressure. The term "high boiling solvent" refers to hydrocarbon solvents possessing a boiling point above about 400° F. "Low vapor pressure" solvent refers to solvents having a vapor pressure less than about 0.01 mmHg at 25° C. The solvents are normally selected from aromatic hydrocarbons having a high boiling point and low vapor pressures as mentioned above. These are characterized as being alkyl phenyl compounds, alkyl benzyl aromatics, biphenyls, diphenyl ethers, diphenyl alkyls, alkyl substituted diphenyl alkyls and mixtures thereof; well known, and widely used, but for other purposes. When an alkyl group is attached to the aromatic nucleus, it usually would be a lower alkyl group having from one to about four carbon atoms. The selection of the solvent and the temperature of the operation can easily be determined by one skilled in the art using simple laboratory equipment.

Another characteristic which is desirable, but not necessarily determinative, is a lack of corrosiveness of the solvent in the presence of common metals and alloys at temperatures which approach the boiling point of the solvent. An especially preferred solvent for the practice of this invention comprises from about 50 wt % to about 66 wt % of 1,1-diphenyl-ethane and from about 50 wt % to about 34 wt % of an ethylated benzene. The amount of ethylation on the benzene is not critical, but normally there would not be more than three ethyl groups attached to a single aromatic ring. This mixture is commercially available under the name DOWTHERM™ Q and is currently available from the Dow Chemical Company and from Apogee Engineering, Inc. as HT Solve 515™. Other preferred aromatic heat transfer fluids are sold under the tradmark THERMINOL by Solutia Corporation. One particularly preferred is THERMINOL 59 which is a mixture of ethyl diphenyl ethane, diphenyl ethane, diethyl diphenyl ethane and ethyl benzene. This aromatic heat transfer fluid boils at 289° C., melting point −61° C., specific gravity of 0.971 @25° C. and a vapor pressure of 0.002 mmHg @25° C. making it an outstanding candidate for use in the process of this invention. Other commercially available aromatic thermal fluids include "alkylated aromatics" (THERMINOL® FF) with a boiling range of 420° F. to 550° F. and a mixture of about 73% diphenyl ether and 27% biphenyl (THERMINOL® VPI) The foregoing is mentioned to give those skilled in the art guidance to selecting an aromatic hydrocarbon or a mixture of them for evaluation and, if successful, use in the process of this invention.

The versatility of the process of this invention is manifest in the diversity with which the process can be practiced to service the particular needs of the customer. The equipment is sufficiently compact to be skid-mounted and carried by truck to the chemical plant where the olefinic polymer is being produced. On the plant site, through the use of a suitable frame or rack to hold the equipment, the fouled process equipment, if a shell and tube reactor or heat exchanger, can be positioned either vertically or horizontally, shell and tubes, such that a circulation unit can be connected to perform the process. It will be recognized by those skilled in the art that the orientation of the equipment will depend on many factors such as draining ability, accessibility, lifting capabilities and net positive suction head requirements for pumps used to circulate the fluid. It is also possible, and preferable, with appropriate piping, to establish a cycle, or loop, for circulating heated solvent through the reactor without removing the reactor from the operating facility, being appropriately blanked from the rest of the process, of course. Yet another way in which the cleaning process of this invention may be practiced is at a facility off the plant site to which the reactor can be transported and then placed in a frame holding the shell of a shell and tube reactor system for cleaning by contacting the olefin polymer mass with the high-boiling, low-vapor-pressure aromatic hydrocarbon solvent for cleaning.

For purposes of discussion, the invention will be described in the context of a shell and tube exchanger, understanding that the invention is not limited thereto. Turning to FIG. 1, the tube bundle fouled with the olefinic polymer mass is placed in a temporary stand that holds the exchanger 10 in a suitable position. The outer surface of the shell is preferably insulated in order to retain the heat necessary to perform the cleaning step rapidly and efficiently. The high-boiling aromatic solvent is taken from an appropriate storage facility 12 or holding tank and pumped into the pump suction line 19 via pump 15 and line 13 and passed through pump 14 and heater 16 where it is heated to the temperature at which it will be used, at least about 200° F. and preferably from about 250° F. to about 600° F. During the cleaning effort the temperature can be varied depending upon judgment of the operator. The heater may either be an electric or direct fuel-fired heater or those which may use a thermal fluid to heat the solvent in small shell and tube heaters as are well known to the skilled engineer. The heated high-boiling aromatic solvent is then circulated through piping 18, preferably insulated, to the shell 10 containing the tubes coated, shell side, for purposes of discussion with the olefinic polymer mass. Of course, the olefinic polymer mass could be in the tubes, in which case the aromatic solvent would be routed through the tubes to contact the mass.

The liquid flows through the mass filling the shell 10 with the hot solvent in contact with the polymer mass. If the exchanger has been steamed out to remove the process solvent, water will be present in the polymer mass. If the exchanger has not been steamed out, some of the solvent from the solution polymerization will remain in the polymer mass. In either case this water or process solvent will cause pressure in the system to increase due to the high vapor pressure at the high solvation temperatures of the process. The water vapor or process solvent vapor is vented from the system via a vent line 21 which conducts the vapor to a water-cooled condenser 22 and then into a storage vessel 24 via suitable piping 23. The condensed liquid will either be water or the process solvent. If it is water, it can be disposed of via a suitable wastewater treatment facility. If it is process solvent, it will also contain some of the high boiling polymer removal solvent which is then processed in the equipment in FIG. 2 to recover both the process solvent and the high boiling point polymer removal solvent, both for recycle. The high temperature solvent can be circulated through or held within the shell for a time sufficient to dissolve at least a portion of the polymer and then cycled out through line 20, which is cooled via cooler 17, and replaced with fresh, heated solvent.

Since the saturation level of the polymer in the high-boiling solvent has been found to normally be low, less than about 25 wt % at elevated temperatures, the circulation rate should be adjusted such that the retention time in contact with the polymer being removed is from about 5 to about 30 minutes, preferably from about 10 to about 20 minutes. Of course the residence time will vary according to the ease with which a specific olefinic polymer mass is dissolved from the equipment surfaces. Residence time will vary as the flow rate is varied from about 350 to about 4000 gallons per minute. As the polymer is removed and flow becomes less restricted, the flow rate through the reactor may be adjusted to become either faster or slower depending on the rate of removal of the polymer mass and the level of saturation of polymer within the solvent. Likewise, the temperature may be adjusted according to the same criteria during the operation of the process. Care must be taken that the temperature must be maintained sufficiently high that the polymer mass does not begin to solidify in the solvent. Circulation can continue through line 19 back to pump 14 for re-circulation through the shell 10.

The pressure within the shell 10 while being treated is normally from about 5 to about 50 psig. The temperature would normally be monitored at the lower extremity of the shell 10 containing the tube bundle being cleaned. The pressure is maintained to assure that the equipment being cleaned is kept full of heated solvent and provide a suitable net positive suction head to the intake of the pump. The solvent would normally be withdrawn from the shell containing the tube bundle through line 19 for recycle at a sufficient flow rate to maintain a linear flow velocity of at least about one foot per second resulting in sufficiently high turbulence inside the shell and around the tubes to facilitate dissolving of the polymer mass. The flow rate mentioned previously of from about 350 to about 4,000 per minute has been found to be satisfactory for cleaning most olefin reactors using the solution polymerization process for olefins and, while maintaining a particular Reynolds Number is one way of determining flow rate, the adjustment of the rate from about 350 to about 4,000 gallons per minute has been found to be satisfactory. A relatively small stream, usually from about 3 to about 6 gallons per minute, preferably about 4 gpm, is withdrawn through line 20 and collected in a tank 11 usually a portable tank such that the solvent and polymer can be removed from the customer's plant. This stream may also go directly to a solvent recovery system via lines 28 and 29 so that polymer loaded solvent is continuously taken out of the system and is replaced with fresh or recovered solvent through recycle lines 79. When operated as a continuous process including solvent recovery, the smaller stream may vary substantially from the above amounts.

It is preferable that the output of the pump 14 or heater 16 have a manifold (not shown) which would allow the direction of flow to be reversed so that the solvent could be directed to flow in either direction in the shell in order to assure complete cleaning of the polymer from the equipment. It has been discovered that flow in both directions improves removal of the olefinic polymer fouling.

Figure 2:
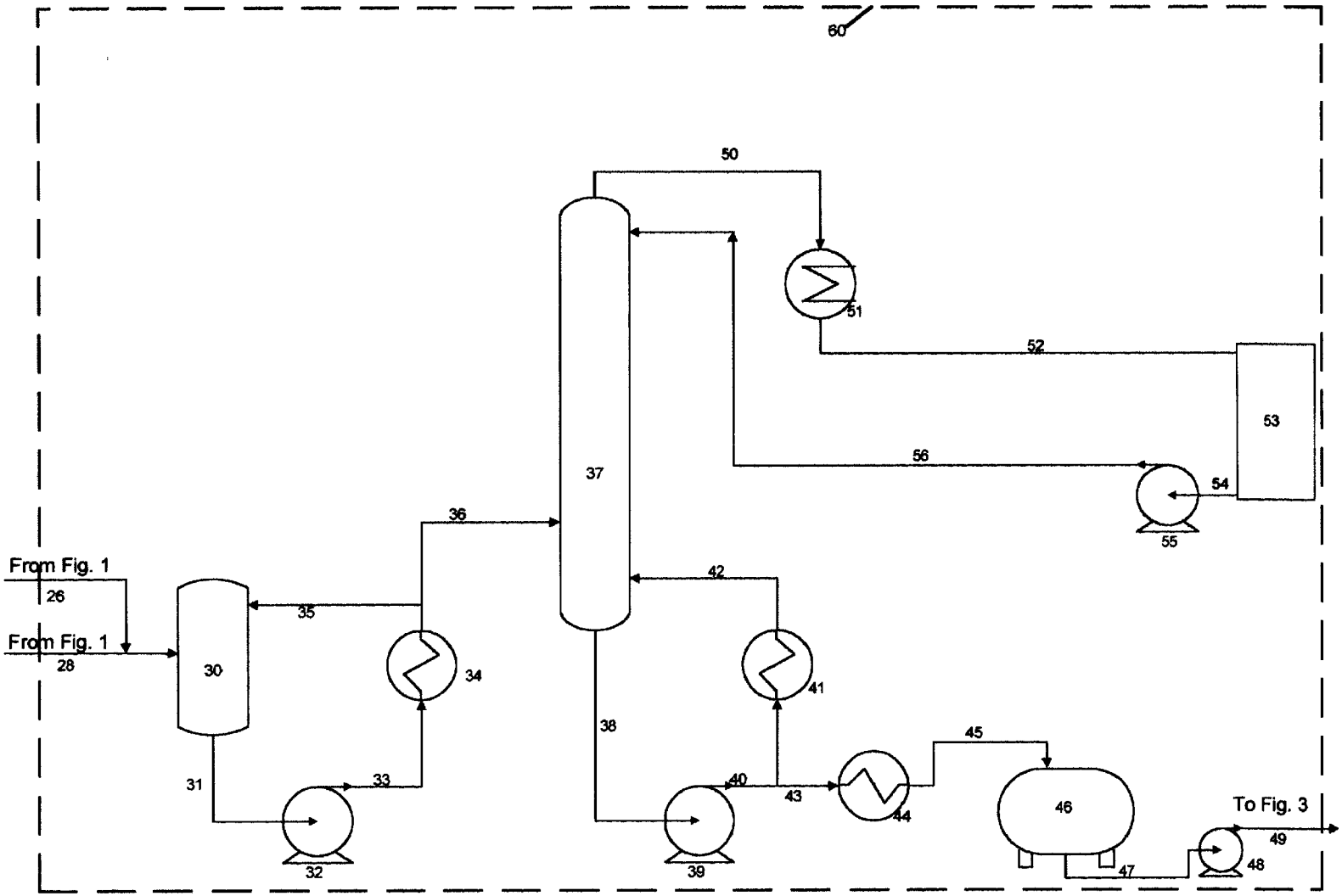

FIG. 2 shows a preferred, simplified process solvent recovery system 60. The condensed liquid in vessel 24, if it is a mixture of process solvent and high boiling point polymer removal solvent is pumped into the low boiling point process recovery system 60 via pump 25 and line 26. Likewise, the polymer-laden solvent in tank 11 is pumped to the process solvent recovery system 60 via pump 27 through line 28. These two streams in lines 26 and 28 flow into a small vessel 30. The contents of this vessel are heated with heater 34 shown as a forced circulation mode with line 31 to pump 32 to line 33 to heater 34 and back to vessel 30 via line 35. A smaller stream 36 feeds this liquid to a distillation tower 37 where is separated into a process solvent fraction, being substantially free of the high boiling solvent, exiting out the top of the tower via line 50 and a stream 38 exiting the bottom of the tower 37 containing the high boiling aromatic solvent and the polymer fouling removed from the process vessel. Line 50 conveys the vapors to a condenser 51 where they are condensed and stored in a temporary storage tank such as a 550-gallon tote tank 53 accessed through line 52. Reflux to the tower is pumped back to the top of the tower via lines 54 and 56 and pump 55. The line 38 exiting distillation tower 37 goes to a circulating pump 39, which pumps the boiling liquid to heater 41 via line 40 and then the main stream is conveyed back into the bottom of tower 37 via recirculation line 42. A bleed stream 43 from the recycle loop including pump 39 is passed through cooler 44 and conveyed to tank 46 via line 45 where it is collected to provide feed for separation of the polymer from the solvent.

Figure 3:
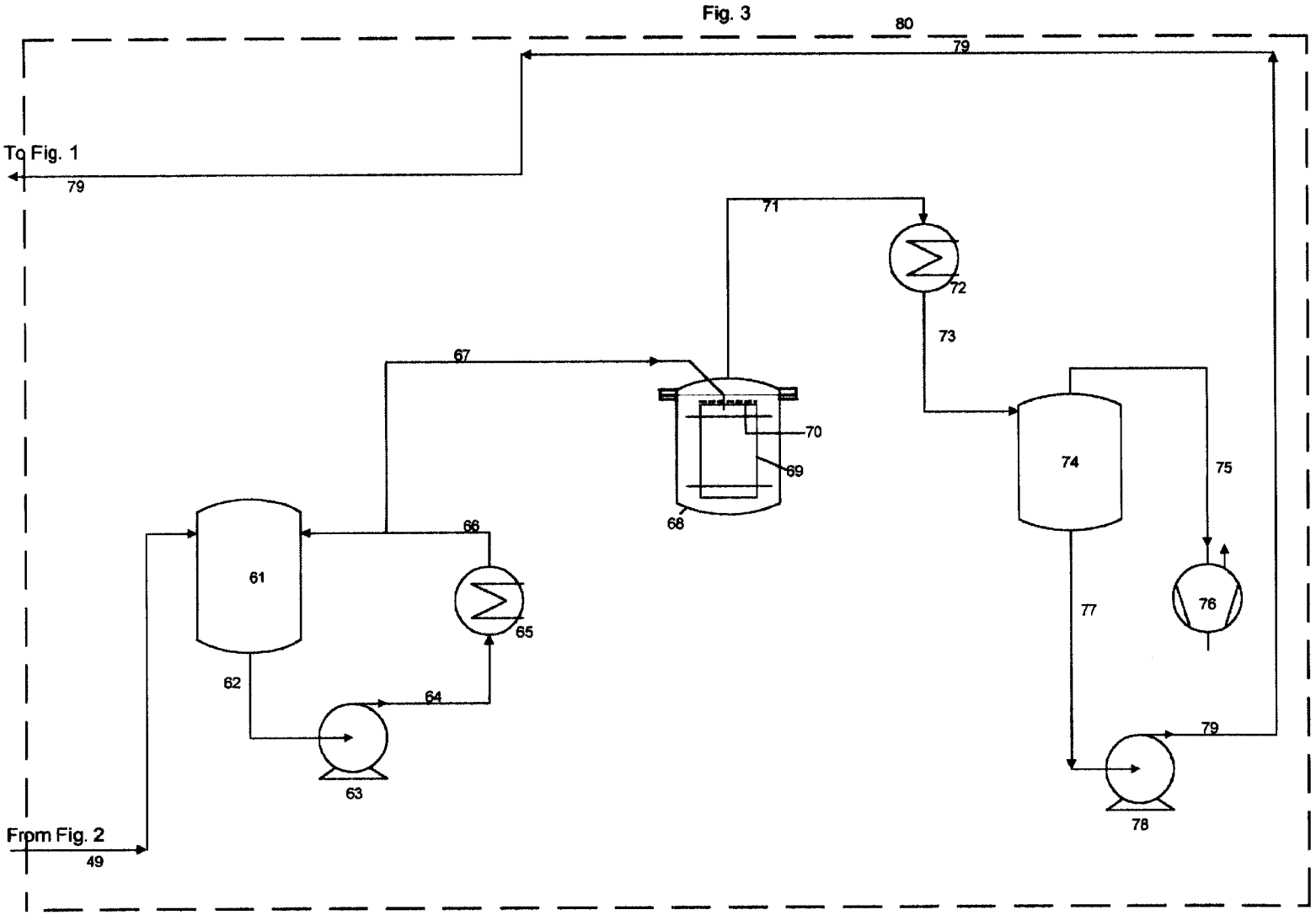

The embodiment of FIG. 3 also shows a preferred, simplified solvent recovery and recycle system integrated into the removal system for taking the olefinic polymer fouling from the reactor. It must be understood that the solvent containing the polymer could merely be collected in a container such as the 550 gallon tote tank mentioned above and then, using the tank as a feed, separate the olefinic polymer mass from the high boiling, low vapor pressure solvent at a central facility or some other location. When this step of circulation is used, it is not necessary to hold the solvent within the vessel being cleaned. Here the solvent would heat and remove polymer continuously through the contact with it. It would be necessary, however, to monitor the concentration of polymer within the solvent so that saturation levels of the aromatic solvent not be seriously approached since complications could arise concerning solvent recovery. However, as is discussed hereafter concerning the solvent recovery system and embodiment of this invention, the concentration of polymer would be controlled through the recovery. It is not necessary for the practice of this invention that all olefinic polymer removed from the equipment be removed from the solvent on each pass, only that the concentration of the polymer within the solvent remain safely below the saturation level which varies with the temperature of the solvent being used. The same screening test run to determine the suitability of the aromatic solvent can also be used to approximate the solubility of the polymer in the solvent. The solvent containing the dissolved polymer may also be removed from the equipment on a batch basis and held in portable containers for subsequent processing for solvent recovery. When batch removal is practiced, fresh solvent would be pumped into the shell 10 to dissolve additional polymer and the steps would be repeated until the equipment is cleaned.

It is preferred for the embodiment involving circulation of the solvent to continue circulation until the solvent approaches being saturated with polymer. Once the equipment is full of solvent, circulation through the equipment is carried out at flow rates specific for the equipment being cleaned. Flow rates are calculated to result in linear flow velocity of at least about 1 foot per second. The flow rate will normally vary from about 200 to about 4000 gpm, preferably from about 300 to about 1700 gpm.

As an embodiment to be operated on a continuous-circulation basis, the bleed line 20 from exit pipe 19 of the exchanger shell 10 would be connected to the feed drum 30 in the process solvent recovery system 60 and processed as described above. The polymer laden solvent mixture is pumped out of storage vessel 46 via line 47 through pump 48 and line 49 into the feed drum 61 in the recovery system 80 for the high boiling solvent used in practice of cleaning the reactor. The contents of feed drum 61 is maintained at an elevated temperature of from about 450° F. to about 575° F., preferably from about 495° F. to about 550° F., by circulating the contents through a heater 65 with lines 62, 64 and 66 and pump 63. A smaller stream is taken off line 66 via line 67 and injected into flash drum 68. The temperature of the solvent containing the polyolefin fouling is elevated sufficiently to cause an adiabatic flash of the solvent in this mixture upon introduction into drum 68 at reduced absolute pressure. Preferably it is maintained at a vacuum of from about 28 to about 29.9 inches of mercury (about 0.50 to about 48.8 mm Hg). The solvent flashes to form a vapor, leaving the flash drum 68 through line 71. The polymer remains in the flash drum 68. Inside the flash drum 68 is a removable container 69, preferably an open-top steel drum such that the polymer can be simply collected in the container 69 and removed by removing the head of the flash drum 68 and lifting out the removable container 69. Of course these solvent recovery may be varied according to the solvent selected. Such adjustments are within the ability of the skilled engineer.

In some instances the polymer being removed from the process equipment may remain in a condition where it could be pumped. In that case, there would be the option of using the removable container to collect the polymer and allowing it to collect in the bottom of the flash drum 68 through an appropriate tap in the flash drum 68, not shown.

The polymer and solvent solution is sprayed into the flash drum 68 from line 67, which extends into the steel drum through a hole in a screen 70, which is placed on top of the steel drum 69. The line 67 is fitted with a suitable spray nozzle on the end where it sprays into the removable container 69. The screen 70 is positioned in order to restrain the entrainment of foam, if any, produced by the flash evaporation of the solvent. To further control the foaming problem an antifoaming agent such as, for example, Dow Corning 1400 antifoam compound may be used to coat the metal screen 70 placed on top of the removable container 69. In some conditions of operation or in selection of the high boiling low vapor pressure solvent, the solvent recovery can be accomplished with the creation of foam in the system and in such cases, both the removable container 69, the metal screen 70 and any anti-foam compound would be unnecessary. However, where there is resulting foaming in the system, the container, screen and anti-foam agent are effective in establishing solvent recovery.

The solvent leaves as a vapor through line 71 and condenser 72, through line 73 and thence into a collection drum 74 from which it can flow to pump 78 via line 77 and then be pumped back to the storage tank 12 (FIG. 1) through line 79. The condenser 72 is preferably water-cooled, shell and tube heat exchanger with water flowing through the tubes. The use of the storage tank 12 allows flexibility in the amount of recycle so that the rate can be increased or decreased as needed during the practice of the invention to remove the olefinic polymer fouling. The flash drum 68, the condenser 72, the collection drum 74 and all of the interconnecting piping is maintained at a medium vacuum with a vacuum pump 76 connected to the system with line 75. Since heat losses in and around the flash drum 68 are unavoidable, electric strip heaters are preferably attached to the outside of the flash drum 68 shell and it is heavily insulated. Other methods of maintaining the temperature are also appropriate. When used, these electric strip heaters are controlled with surface mounted thermostats set on about 425° F. depending upon the solvent and polymer combination. These heaters also are advantageous for boiling the solvent out of the removable container 69 after the feed to the flash drum 68 has been terminated. Some solvent may collect in the flash drum 68 if, for example, process solvent has diluted the oil in vacuum pump 76 and as a result the vacuum has not been sufficient to flash off all of the solvent during a recovery run.

Those skilled in the art are versed in the design and operation of a flash drum to separate materials having different levels of volatility and therefore understand the application of a combination of temperature and pressure drop, whether created by a bacl pressure control valve operating on a pump having high output or whether a vacuum is drawn on the flash drum. In the practice of our invention, it is a matter of engineering choice based on a balancing of cost dictated in part by the solvent being used and the olefinic polymeric material being removed with this solvent.

Thus, it can be seen by the foregoing description that the process of this invention provides wide latitude with respect to its operation to remove the polymer residues from reactor surfaces, particularly the tube bundles forming the indirect heat transfer surfaces within the reactor.

In the context of preparation for the use of the cleaning process of this invention, those dealing with the cleaning of olefinic polymer mass must be cognizant of the presence of the reaction solvent used in the preparation of the olefinic polymer, often cyclohexane, and other solvents known to be used for the solution polymerization of olefins. These solvents have a relatively high vapor pressure, thus raising the possibility of becoming a hazard at cleaning temperatures.

The selection of appropriate solvents for a given polymer as well as the determination of the temperature to use can be made with simple experimentation. A spherical glass laboratory stirred reactor with external heating and fitted with thermo-couples can be used. A sample of the polymer was placed in the equipment with the air being evacuated by a nitrogen blanket kept on the reactor. The reactor was fitted with a condenser and water trap to catch any fumes which may be exhausted from the reactor. The temperature was set, the stirrer turned on and kept in that condition for an arbitrary number of minutes or until there was a dissolution of the polymer. Table 1 following shows the results of a number of these tests using the DowThem® Q thermal fluid as solvent.

TABLE 1

| Sample Description | Temp ° F. | Time | Results |
|---|---|---|---|
| EPDM | 450° | 30 mins | complete dissolution; solution turned dark-black |
| EPDM | 450° | 90 mins | complete dissolution; gelled when cooled <350° |
| polystyrene deposit | 400° | 90 mins | complete dissolution |
| latex sample | 400° | 1 hr | complete dissolution |
| fresh sample of sytrene | 400° | 1 hr | complete dissolution |
| SBS rubber sample | 300° | 30 mins | complete dissolution |
| polystyrene | 400° | 90 mins | complete dissolution |
| sample from furnace flue gas line | 450° | 30 mins | partial dissolution |
| EPDM | 450–500° | 90 mins | complete dissolution; fluid more viscous |

From the table and the foregoing description, it can be seen that the solvent selection and determination of solvent temperature is a relatively easy, straightforward step.

The foregoing invention will be further demonstrated and explained through the following examples, which are offered for purposes of exemplification and not limitation of the invention described herein.

EXAMPLE 1

A heat exchanger heavily fouled on the exterior of its tubes with a polystyrene olefin polymer was positioned in a vertical orientation of its longitudinal axis in a rack designed for the purpose. The outlet of a pump was connected to the top end of the heat exchanger shell by a 3" pipe. The line and heat exchanger shell were insulated to minimize heat loss. The drain at the bottom of the shell was connected to the intake of the pump and a portable collecting tank. The intake of the pump was connected through a heater to 555-gallon tote containers containing an aromatic solvent sold as DOWTHERM™ Q. The set point of the heater was initially set at 250° F., and the system was circulated at a rate of about 375 gpm to heat the solvent. The return line to the system was arranged so that a bleed stream of solvent could be directed toward the collecting tote tank. The flow rate was 375 gpm at a temperature that was gradually increased to 500° F. with fresh solvent available to replace that which had become saturated and/or otherwise ineffective for further solvency. The tank and lines were insulated in order to minimize heat loss.

Vapors from the open vent of the tote tank receiving the solvent were observed during the operation indicating that steam was being driven from the fouled heat exchanger, which had been steamed out to remove cyclohexane solvent. During operations, the suction pressure on the pump was from 25 to 55 psig, with the temperature set point initially at 290° F. to 300° F. Fresh solvent was required to replace the solvent being removed containing the dissolved polymer. The system was operated to remain filled with solvent, and in this instance required 875 gallons to fill it.

The experiment continued for three days with the equipment being shut down at night. The first day involved setting up the system and beginning operation. On the second day, additional aromatic hydrocarbon was added and continued pumping and circulation occurred with the presence of water being noted. On the third day, the system was circulated, and the temperature raised to about 500° F. then drained with the heat exchanger being removed from the stand and inspected. The heat exchanger shell was opened and the tubes were bright and clean. This heat exchanger was placed back into commercial operation and was run for over six months, an appreciable increase over the expectation of 4 months running time between cleaning via furnace burnout which existed prior to the practice of this invention.

EXAMPLE 2

Using the equipment and following the procedure described in Example 1, a heat exchanger fouled with a mass of styrene butadiene styrene rubber polymer (SBS rubber) was placed in the position for cleaning. The heaters were turned on and 895 gallons of aromatic solvent (DOWTHERM Q) was pumped into the system. The initial temperature was approximately 275° F. Circulation was established at this temperature and again the expelling of steam was noted. The temperature setting was raised progressively from 275° F. to 300° F., then 325° F., then 375° F. over a period of one hour. The vent line was opened and a portion of the material was removed. Upon completion of the cleaning circulation after a total of about 7 hours spent over two days, the solvent was again drained to the tote containers and the heat exchanger removed from the stand was allowed to cool, opened and the tubes inspected. On observation these tubes were not quite as shiny clean as previously, but were sufficiently cleaned. The difference was attributed to the presence of additional water in the SBS rubber and the shortened period of circulation.

EXAMPLE 3

In this example the heat exchanger was fouled with polystyrene. Again, the solvent, equipment and procedure of Example 1 was used. In operating the system, the heat exchanger was again oriented vertically in the rack with the fill pipe connected to the upper end of the exchanger. The system was filled with the aromatic hydrocarbon solvent with the vent open to expel the air. The aromatic hydrocarbon solvent used for this cleaning job, was the third time it had been used. It was used for the first time on the final shot on the first styrene exchanger (Example 1). The second exchanger was the SBS rubber exchanger (Example 2).

The solvent was heated with the set point moved during the first three hours of operation from 275° F. to about 400° F. The flow rate went down and required the system to be shut down for a while. One drum (55 gallons) of fresh solvent was added to the system and flow rate established. The liquid in the system was a very viscous emulsion. It was vented to the tote tank, and the material inspected and noted to be a combination of water and an emulsion. Three 55 gallon drums of additional fresh solvent were added to the system with vapor venting continuing while heating. The material in the tote tanks began to foam during the bleed-down and made it necessary to reduce the pressure that had built up inside the unit.

Because of the circulation problems, the system was drained into the tote tanks with the vent to the system open and steam coming off the top of the unit. After a time, the steam flow abated and the drained system was running smoothly. At that point more fresh solvent was added to fill the system and now the vent line began to give off foam indicating that water was in the system. The system was drained while circulating and the tote was foaming. The heat exchanger was removed and inspected, and appeared clean, though not as clean as the first styrene exchanger. This example demonstrates the desirability to have access to the equipment being cleaned without the application of steam to remove the solvent used for processing the olefin into a polymer. However, it also demonstrates the defouling of the process equipment can be accomplished even with the water caused or light solvent caused, foaming.

EXAMPLE 4

A heat exchanger fouled with SBS rubber was placed in position and purged with air for two days to evaporate water remaining from steam-out operations. It was closed and pressure checked for leaks. The system was filled with the solvent as before with all the heaters turned on. After the system was loaded with approximately 600 gallons, the pump was started to establish circulation. Some of the bubbling sound reoccurred as had been the case with the prior SBS cleaning, which was attributed to water being released from the system toward the vent. Once the vent is closed, the water sounds ceased. Circulation was established and the temperatures set at 500° F. to circulate the system as nearly as possible in steady state. Samples of the solvent were drawn and analyzed by evaporation of the solvent to determine the amount of polymer residue collected. It was determined that the duplicate samples contained 3.3 wt % of polymer residue. The approximate liquid volume within the filled exchanger in this example was 1,035 gallons. Counting the time when the unit was down, either due to shutdown for maintenance or over night, the solvent was either in contact with the SBS polymer cake or circulating through same for a period of 18 hours. The temperature setting throughout the operation averaged at about 500° F. with the flow rate set to maintain approximately 350 gpm. Three volumes of solvent were used in this example. The heat exchange tube bundle was inspected and all tubes and other metal surfaces were bright shiny surfaces. The presence of water in the polymer mass being removed complicates the cleaning process as is shown by this example since it becomes intertwined with the polymer cake attempted to be removed and is itself removed only with difficulty.

In the practice of this invention when operated on the client's plant site, the steaming required for transportation would be unnecessary and the presence of the water intermingled with the polymer eliminated. The on site use is a decided advantage of the process of this invention.

Since the removal capability of the solvent is diminished with the presence of polymer at or near the saturation concentration of polymer, it is preferable to operate an acceptable solvent recovery system and preferably one which is operable on a continuous basis.

EXAMPLE 5

This example demonstrates the test development of the solvent recovery system of this invention.

Solvent containing dissolved polymer was placed in laboratory flask and heated on a hot plate. The system consisting of a 250 ml evaporating flask was connected to the inlet of a water-cooled condenser to remove solvent vapors which were condensed into a second 250 ml flask immersed in an ice water bath via tubing and fitted with a cold finger trap connected to a mercury manometer and vacuum pump.

A sample of about 100 ml of solvent saturated with polystyrene polymer from an Example 3 above was heated at an absolute pressure maintained at about 2 mm Hg. When the mixture reached the boiling point, a dense, stable foam was formed in the evaporating flask. This foam was a round-bubbled foam consisting of a dispersion of spherical vapor bubbles contained in thick films of the bulk liquid. This type of foam is much more stable than the polyhedral foams comprising large pockets of vapor separated by thin films of bulk liquid and was more difficult to control via mechanical means.

The above Example 5 was repeated with the addition of about 100 ppm of antifoam compound (Dow Corning 1400) being placed in the solvent/polymer solution. Again, foam formed during the evaporation step.

The experiment was again repeated, except this time a circular section of stainless steel wire mesh coated with antifoam compound was suspended about two-thirds of the way up from the bottom of the evaporating flask so that the circumference of the wire mesh touched the flask. As the mixture started to boil a large amount of foam was generated. Without decreasing the heat input, the mixture was allowed to continue boiling. Solvent was observed condensing on the wire mesh and dripping off. The system continued to foam and reach the wire mesh. The foam filled the space below the wire mesh, but did not go past the wire mesh. As the solvent gradually evaporated out of the flask, the foam gradually subsided below the wire mesh. The solvent was allowed to evaporate and 84 ml. was recovered in the second flask. A coating of polymer residue remained in the flask. The 84 ml of recovered solvent was used to dissolve a sample of an olefinic polymer deposit out of an elastomeric process using the test procedure described earlier. The recovered solvent retained its solvency powers equal to the original solvent.

EXAMPLE 6

The above Example 5 was repeated with a different polymeric deposit laden solvent mixture. This sample was saturated with polymer and had formed a gel upon cooling after being used in the cleaning process. A 99.2 gram sample of the solvent was placed in the evaporator flask without antifoam compound or a wire mesh. As heat was applied, the gel turned to a liquid. Additional heating produced boiling without foaming. The absolute pressure was about 22 mm Hg. The temperature inside the evaporator flask at the start of vigorous boiling was 307° F. All the solvent was evaporated off the sample and the condensed solvent recovered. The recovered solvent was measured at 98.5 ml, and the weight was 94.0 grams, or 94.76% of the original weight.

EXAMPLE 7

In this example, the solvent recovery process used in the processes of this invention will be described based upon a field recovery operation. About 3,800 gallons of polymer laden spent solvent collected from the field trials described above was processed through the solvent recovery system 80 operating separately from the polymer removal unit but at conditions previously described. Since the spent solvent had cooled to ambient temperature, the feed rate to the solvent recovery system 80 was limited by the capacity heater 65, which was sized based on feeding hot spent solvent during cleaning operations. The feed rate was limited to about 2 gallons per minute and required several days operation to process the solvent, since operations were terminated at night. The system required reheating the following day. Due to excessive heat losses and vacuum leaks causing the absolute pressure to be too high, only about 3,500 gallons of solvent was recovered, some of it remaining with the polymer as a very viscous fluid that was disposed of in drums via fuel blending. Some of the difference in the 3,500 gallons recovered vs. the 3,800 gallons of spent solvent fed can be explained by the amount of polymer in the spent solvent. The recovered solvent was water white and looked better than the virgin material and was used to clean additional heat exchangers where its performance was equal to virgin material even after several cycles of solvating polymer and recovery.

Having described the invention for removing an olefinic polymer mass from reactor surfaces and having exemplified same, those skilled in the art, reading this description will readily think of obvious and simple modifications thereof, which are intended to be within the scope of this claimed invention as set forth in the following claims.

We claim:

1. A process for removing an olefinic polymer mass buildup on process equipment surfaces occurring during solution polymerizing of an olefin monomer comprising the steps of:

heating an aromatic hydrocarbon solvent capable of dissolving the olefinic polymer to a temperature of from about 200° F. to about 600° F., the aromatic solvent having a boiling point above about 400° F. and a vapor pressure of less than about 0.01 mm Hg measured at 25° C.;

contacting the olefin polymer mass with the heated aromatic hydrocarbon solvent at a pressure of from about 5 psig to about 50 psig for a time sufficient to dissolve at least a portion of the olefinic polymer mass; and removing the solvent and dissolved polymer from the equipment.

2. The process of claim 1 wherein the aromatic solvent comprises from about 50 wt % to about 66 wt % 1,1 diphenylethane and from about 34 wt % to about 50 wt % of an ethylated benzene.

3. The process of claim 2 wherein the solvent is circulated from the process vessel through the heater back to the process vessel until the polymer mass is removed.

4. The process of claim 1 wherein at least a portion of the solvent containing dissolved olefinic polymer is drained and replaced with additional heated solvent.

5. The process of claim 1 including the additional step of flashing at least a portion of the solvent containing the dissolved olefinic polymer at conditions to remove polymerization reaction solvents; and recovering the aromatic solvent containing the dissolved polymeric mass substantially free of the reaction solvents having high vapor pressure.

6. The process of claim 5 including the additional step of flashing at least a portion of the aromatic solvent containing the dissolved olefinic polymer at conditions to remove high-boiling, low vapor pressure solvent from the mixture containing the dissolved polymer.

7. The process of claim 6 wherein the solvent recovered is recycled to the process equipment to again contact the polymer mass.

8. The process of claim 7 wherein heating is periodically resumed to maintain the desired temperature.

9. The process of claim 1 wherein the heating and contacting step occur simultaneously until the desired temperature is reached.

10. A process for removing an olefinic polymer mass buildup from process surfaces of equipment without relocating the equipment from the site where it normally operates which comprises the steps of:

isolating the equipment to be cleaned from process and through the equipment establishing a loop for circulating a solvent for the olefinic polymer mass in the equipment;

heating an aromatic hydrocarbon solvent for the olefinic polymer mass to a temperature of from about 200° F. to about 600° F., the aromatic solvent having a boiling point above about 400° F. and a vapor pressure of less than about 0.01 mm Hg, measured at 25° C.;

circulating the heated aromatic solvent through the solvent circulation loop to contact the olefin polymer mass in the equipment for a time sufficient to dissolve at least a portion of the olefinic polymer mass resulting in a solution of aromatic solvent containing dissolved polymer; and removing the solvent and dissolved polymer from the equipment.

11. A process for removing an olefinic polymer mass occurring during an olefin monomer polymerization from process equipment surfaces which comprises the steps of:

heating an aromatic hydrocarbon solvent capable of dissolving the olefinic polymer to a temperature of from about 200° F. to about 600° F., the aromatic solvent having a boiling point above about 400° F. and a vapor pressure of less than about 0.01 mm Hg measured at 25° C.;

circulating the heated solvent through the equipment contacting the olefinic polymer mass at a rate of about 350 to 3,000 gpm to form a polymeric mass removed solution of the solvent for the olefinic polymer mass, a polymerization reaction solvent used as the reaction medium to prepare the olefin polymer, and the dissolved olefinic mass;

recovering the polymerization reaction solvent from the polymeric mass removal solution containing dissolved polymer and the polymer solvent;

recovering the polymeric mass removal solvent leaving a polymeric mass for disposal; and recycling the recovered polymer removal solvent to the equipment being cleaned.

12. The process of claim 11 wherein the polymer mass recover removal solvent is recovered through a flash distillation step.

13. The process of claim 11 wherein the aromatic solvent comprises from about 50 wt % to about 66 wt % 1,1-diphenyl ethane and from about 34 wt % to about 50 wt % of an ethylated benzene.

14. The process of claim 11 wherein comprising the additional steps of:

withdrawing a portion of the polymeric mass removal stream containing dissolved polymer from the equipment from which the olefinic polymer mass is being removed;

heating the withdrawn stream to flash distillation conditions; and spraying the stream into a flash vessel operating at an absolute pressure of from about 12 mm Hg to about 40 mm Hg to flash the aromatic hydrocarbon solvent from the dissolved polymer; and recycling the recovered aromatic polymer solvent for use in removing the polymer mass.

* * * * *

UNITED STATES PATENT AND TRADEMARK OFFICE

CERTIFICATE OF CORRECTION

PATENT NO. : 6,644,326 B2
DATED : December 12, 2003
INVENTOR(S) : Dorton et al.

It is certified that error appears in the above-identified patent and that said Letters Patent is hereby corrected as shown below:

Title page,
Item [76], Inventor, "Mike Dorton's" address is listed as "Midland, Texas", and should be changed to -- Midland, Michigan --.

Signed and Sealed this

Second Day of March, 2004

JON W. DUDAS
*Acting Director of the United States Patent and Trademark Office*